US007289961B2

(12) United States Patent
Bocko et al.

(10) Patent No.: US 7,289,961 B2
(45) Date of Patent: Oct. 30, 2007

(54) DATA HIDING VIA PHASE MANIPULATION OF AUDIO SIGNALS

(75) Inventors: Mark F. Bocko, Caledonia, NY (US); Zeljko Ignjatovic, Rochester, NY (US)

(73) Assignee: University of Rochester, Rochester, NY (US)

( * ) Notice: Subject to any disclaimer, the term of this patent is extended or adjusted under 35 U.S.C. 154(b) by 107 days.

(21) Appl. No.: 10/870,685

(22) Filed: Jun. 18, 2004

(65) Prior Publication Data

US 2005/0033579 A1 Feb. 10, 2005

Related U.S. Application Data

(60) Provisional application No. 60/479,438, filed on Jun. 19, 2003.

(51) Int. Cl.
*G10L 21/00* (2006.01)

(52) U.S. Cl. ..... 704/273; 704/270; 704/253

(58) Field of Classification Search ..... 704/273, 704/270, 253

See application file for complete search history.

(56) References Cited

U.S. PATENT DOCUMENTS 5,937,000 A * 8/1999 Lee et al. ..... 375/141
6,175,627 B1 1/2001 Petrovic et al.
6,266,430 B1 7/2001 Rhoads
6,363,159 B1 3/2002 Rhoads
6,404,898 B1 6/2002 Rhoads
6,427,012 B1 7/2002 Petrovic et al.
6,430,301 B1 8/2002 Petrovic et al.
6,442,283 B1 8/2002 Tewfik et al.
6,526,385 B1 * 2/2003 Kobayashi et al. ..... 704/504
6,539,475 B1 3/2003 Cox et al.
6,560,349 B1 5/2003 Rhoads
6,560,350 B2 5/2003 Rhoads
6,567,780 B2 5/2003 Rhoads
6,633,654 B2 10/2003 Hannigan et al.
6,647,128 B1 11/2003 Rhoads
6,647,129 B2 11/2003 Rhoads
6,650,762 B2 * 11/2003 Gibson et al. ..... 382/100
6,654,480 B2 11/2003 Rhoads
6,674,876 B1 1/2004 Hannigan et al.
6,675,146 B2 1/2004 Rhoads
6,684,199 B1 1/2004 Stebbings (Continued)

OTHER PUBLICATIONS

Gang et al. ("MP3 resistant oblivious steganography", Acoustics, Speech, and Signal Processing, 2001, Proceedings. (ICASSP '01). IEEE, international conference, May 7-11, 2001, p. 1365-1368 vol. 3).*

(Continued)

*Primary Examiner*—Richemond Dorvil
*Assistant Examiner*—Qi Han
(74) *Attorney, Agent, or Firm*—Blank Rome LLP

(57) ABSTRACT

Data are embedded in an audio signal for watermarking, steganography, or other purposes. The audio signal is divided into time frames. In each time frame, the relative phases of one or more frequency bands are shifted to represent the data to be embedded. In one embodiment, two frequency bands are selected according to a pseudo-random sequence, and their relative phase is shifted. In another embodiment, the phases of one or more overtones relative to the fundamental tone are quantized.

10 Claims, 8 Drawing Sheets

U.S. PATENT DOCUMENTS

| | | | | |
|---|---|---|---|---|
| 6,707,409 | B1 | 3/2004 | Ignjatovic et al. | |
| 6,737,957 | B1 | 5/2004 | Petrovic et al. | |
| 6,792,542 | B1 | 9/2004 | Lee et al. | |
| 6,996,521 | B2 * | 2/2006 | Iliev et al. | 704/200 |
| 2002/0034224 | A1 * | 3/2002 | Srinivasan | 375/240 |
| 2002/0107691 | A1 * | 8/2002 | Kirovski et al. | 704/270 |
| 2003/0095685 | A1 * | 5/2003 | Tewfik et al. | 382/100 |

OTHER PUBLICATIONS

H. J. Kim, et al. "Audio watermarking techniques", in *Intelligent Watermarking Techniques*, H. C. Huang, H. M. Hang, and J. S. Pan, (Editor), World Scientific Publishing Co., May 2004.

"Audio Signal Watermaking Based on Replica Modulation", Rade Petrovic, Telsiks 2001, Yugoslavia, Sep. 19-21, 2001, pp. 227-234.

"Data Hiding Within Audio Signals", Rade Petrovic, et al., Telsiks 1999, Oct. 13-15, 1999, pp. 88-95.

* cited by examiner $$H_M(z^{-1}) = \frac{H_i(z^{-1})}{1-z^{-1}} \quad , \quad H_i(z^{-1}) = A_i \cdot \left( B_{i,0} + B_{i,1} z^{-\frac{1}{2}} + B_{i,2} z^{-1} \right) \quad , \quad i = 1,2,3,\ldots\ldots N$$

1100

DATA HIDING VIA PHASE MANIPULATION OF AUDIO SIGNALS

REFERENCE TO RELATED APPLICATION

The present application claims the benefit of U.S. Provisional Patent Application No. 60/479,438, filed Jun. 19, 2003, whose disclosure is hereby incorporated by reference in its entirety into the present disclosure.

STATEMENT OF GOVERNMENT INTEREST

The work leading to the present invention was supported by the Air Force Research Laboratory/IFEC under grant number F30602-02-1-0129. The government has certain rights in the invention.

FIELD OF THE INVENTION

The present invention is directed to a system and method for insertion of hidden data into audio signals and retrieval of such data from audio signals and is more particularly directed to such a system and method using a phase encoding scheme.

DESCRIPTION OF RELATED ART

Digital watermarking currently is receiving a great amount of attention due to commercial interests that seek to control the distribution of digital media as well as other types of digital data. A watermark is data that is embedded in a media or document file that serves to identify the integrity, the origin or the intended recipient of the host data file. One attribute of watermarks is that they may be visible or invisible. A watermark also may be robust, fragile or semi-fragile. The data capacity of a watermark is a further attribute. Trade-offs among these three properties are possible and each type of watermark has its specific use. For example, robust watermarks are useful for establishing ownership of data, whereas fragile watermarks are useful for verifying the authenticity of data.

Steganography literally means "covered writing" and is closely related to watermarking, sharing many of the attributes and techniques of watermarking. Steganography works by embedding messages within other, seemingly harmless messages, so that seemingly harmless messages will not arouse the suspicion of those wishing to intercept the embedded messages.

As a basic example, a message can be embedded in a bitmap image in the following manner. In each byte of the bitmap image, the least significant bit is discarded and replaced by a bit of the message to be hidden. While the colors of the bitmap image will be altered, the alteration of colors will typically be subtle enough that most observers will not notice. An intended recipient can reconstruct the hidden message by extracting the least significant bit of each byte in the transmitted image. If the bitmap image has eight-bit color depth (256 colors), and the message to be hidden is a text message with eight-bit text encoding, then each letter of the text message can be encoded in and extracted from eight pixels of the bitmap image. While more sophisticated examples exist, the above example will serve to illustrate the basic concept.

The field of steganography is receiving a good deal of attention due to interest in covert communication via the Internet, as well as via other channels, and data hiding in information systems security applications. The single most important requirement of a steganographic method is that it be invisible to all but the intended recipient of the message.

FIG. 1 illustrates the attributes and uses of various categories of watermarking and steganographic techniques. Two dimensions that characterize watermarking and steganographic techniques are visibility and robustness. In FIG. 1, the "visibility" axis extends from visible to undetectable, and the "robustness" axis extends from fragile to robust. In this "attribute" space we show the regions occupied by various watermarking and steganographic techniques. Ideally, steganography should always be undetectable. A third dimension, data capacity, also may be included. In general, enhancement of any of the three attributes—visibility, robustness, and capacity—compromises the other two attributes.

Steganography in digital audio signals is especially challenging due to the acuity and complexity of the human auditory system (HAS). Besides having a wide dynamic range and a fairly small differential range, the HAS is unable to perceive absolute monaural phase, except in certain contrived situations.

FIG. 2 shows the magnitude and phase spectrogram of a few seconds of speech, specifically, a male voice saying, "This is a sample of speech." The upper plot shows the magnitude of the spectrum as a function of time. The bands of horizontal lines represent the overtone spectrum of the pitched portions of the signal. In addition to the usual display of the magnitude of the spectral density (in the upper plot), the phase of the spectrum is also displayed (in the lower plot). The phase of the spectrum is apparently random. This was verified by computing the autocorrelation in frequency of each spectral "slice"; it was found to be highly peaked at zero delay, indicating no correlation.

Two companies, Verance and Digimarc, have introduced schemes for watermarking of audio signals. Those two schemes will be described.

Verance was formed in 1999 from the merger of ARIS Technologies Inc. and Solana Technology Development Corporation. Verance provides software packages to companies interested in controlling the use of their copyrighted digital audio content, but the major application seems to be in broadcast monitoring and verification. For that application, hidden tags are inserted into digital files for TV and radio commercials, programs and music, and a service is provided which monitors all airplay in all major US media markets so that reports can be provided to the advertisers and copyright owners.

In 1999, Verance was selected to provide a worldwide industry standard for copy protected DVD audio and in the Secure Digital Music Initiative (SDMI) and was adopted by the 4C Entity, a consortium of technology companies committed to "protecting entertainment content when recorded to physical media." Verance's audio watermarking technology was intended to embed inaudible yet identifiable digital codes into an audio waveform. The audio watermarks are expected to carry detailed information associated with the audio and audio-visual content for such purposes as monitoring and tracking its distribution and use as well as controlling access to and usage of the content. Embedded watermarks travel with the audio and audiovisual content wherever it goes and are highly resistant to even the most sophisticated attempts to remove them.

The problem with Verance's technology for copyright protection, however, is that it can be hacked. It has been demonstrated that the watermark data can be detected and removed by hackers who were able to discover the key by applying general signal process analysis. This weakness was uncovered in a "hackers challenge" test, set up by the SDMI. The technology has not been accepted by the industry since its announcement in 1999.

Digimarc was founded in 1995 with a focus on deterring counterfeiting and piracy of media content through "digital watermarking," primarily for images and video. It had revenue in 2002 of $80M. Its earliest success came from working with a consortium of leading central banks on the development of a system to deter PC counterfeiting of banknotes. The company provides products and services that enable production of millions of personal identification products such as driver's licenses in more than 33 US states and 20 countries.

Digimarc does not have a significant business in audio watermarking, but about six years ago, Digimarc competed in an open, competitive bid process by the DVD-CCA (DVD Copy Control Association), to protect movies from piracy. The DVD-CCA includes the leading companies from the motion picture, computer and consumer electronics industries. The DVD-CCA decided on Aug. 1, 2002, that the offered technologies from Digimarc and its competitors were inadequate. An interim solution was announced by the DVD-CCA on Sep. 15, 2003. It appears that that the interim DVD-CCA solution is no longer supported.

Other technologies will now be described.

An alternative data protection technique from NEC, as described in U.S. Pat. No. 6,539,475 (Method for protecting digital data through unauthorized copying), has a trigger signal embedded in the data. If the embedded trigger mark is present, the data is considered to be a scrambled copy. The device then descrambles the input data if it detects a trigger signal. In the case of an unauthorized copy that contains a trigger signal with unscrambled data, the descrambler would render the data useless.

The principal weakness of this technology lies in the requirement to remove the protection before the data can be used. If an authorized person is able to insert the recording device after the descrambling, an unprotected and descrambled copy of the data can be made.

In another patent, U.S. Pat. No. 6,684,199, assigned to the Recording Industry Association of America, the system authenticates data by introducing an authentication key in the form of a predetermined error. The purpose is to prevent piracy through unauthorized access and unauthorized copying of the data stored on the media disc. It is one of the few techniques that can survive analog conversion, but it is open to signal processing analysis by hackers.

Examination of various music and speech spectrograms indicates an apparent randomness of phase, which is not surprising since the analysis frequencies of the spectral analysis are not phase coherent with the frequencies present in the signal. So far, however, that apparent randomness of phase has not been exploited for data-hiding purposes.

SUMMARY OF THE INVENTION

It is therefore an object of the present invention to overcome the above-noted deficiencies of the prior art.

It is another object of the invention to realize a technique which resists blind signal-processing attacks.

It is still another object of the invention to realize a technique which can survive digital-to-analog conversion.

It is yet another object of the invention to realize a technique which can survive lossy audio compression, such as MPEG I layer III (MP3) compression, and which can even be applied directly to compressed audio files such as MP3 files.

To achieve the above and other objects, the present invention is directed to a technique in which the phase of chosen components of the host audio signal is manipulated. In a preferred embodiment, the phase manipulation, and thus the hidden message, may be detected by a receiver with the proper "key." Without the key, the hidden data is undetectable, both aurally and via blind digital signal processing attacks. The method described is both aurally transparent and robust and can be applied to both analog and digital audio signals, the latter including uncompressed as well as compressed audio file formats such as MP3. The present invention allows up to 20 kbits of data to be embedded in compressed or uncompressed audio files.

Naturally occurring audio signals such as music or voice contain a fundamental frequency and a spectrum of overtones with well-defined relative phases. When the phases of the overtones are modulated to create a composite waveform different from the original, the difference will not be easily detected. Thus, the manipulation of the phases of the harmonics in an overtone spectrum of voice or music may be exploited as a channel for the transmission of hidden data.

The fact that the phases are random presents an opportunity to replace the random phase in the original sound file with any pseudo-random sequence in which one may embed hidden data. In such an approach, the embedded data is encoded in the larger features of the cover file, which enhances the robustness of the method. To extract the embedded data, one uses the "key" to distinguish the phase modulation encoding from the inherent phase randomness of the audio signal.

The present invention has the advantage over existing Verance algorithms of being undetectable and robust to blind signal processing attacks and of being uniquely robust to digital to analog conversion processing.

The present invention can be used to watermark movies by applying the watermark to the audio channel in such a way as to resist detection or tampering.

The present invention would allow copies of the data to be distributed as unscrambled information, but would contain the capability to identify the source of any copy. For example, a digital rights management system implementing the present invention would inform users as they download music that unauthorized copies are traceable to them and they are responsible for preventing further illegal distribution of the downloaded file.

BRIEF DESCRIPTION OF THE DRAWINGS

Preferred embodiments of the present invention and variations thereon will be set forth in detail with reference to the drawings, in which.

DETAILED DESCRIPTION OF THE PREFERRED EMBODIMENTS

Two preferred embodiments and variations thereon will be set forth in detail with reference to the drawings.

Figure 1:
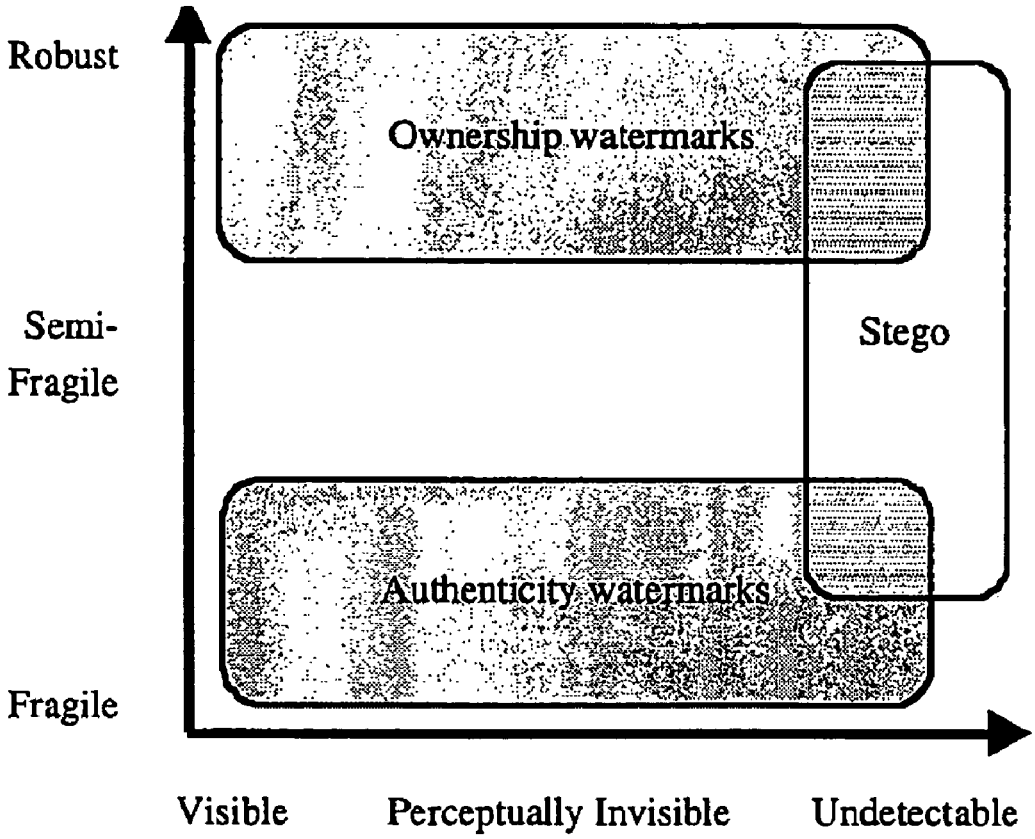
FIG. 1 is a conceptual diagram illustrating the attributes of various data embedding techniques.
Figure 2:
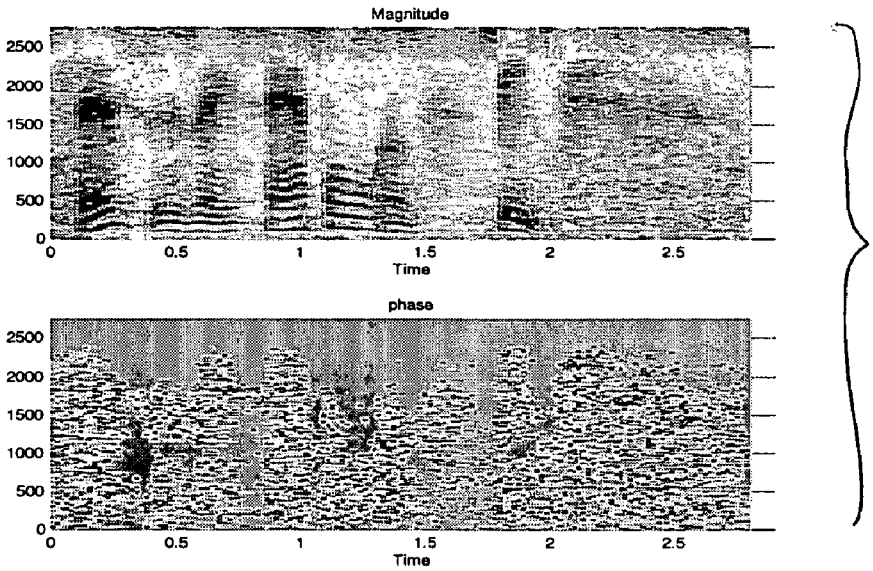
FIG. 2 is a spectrogram showing characteristics of human speech.
Figure 3:
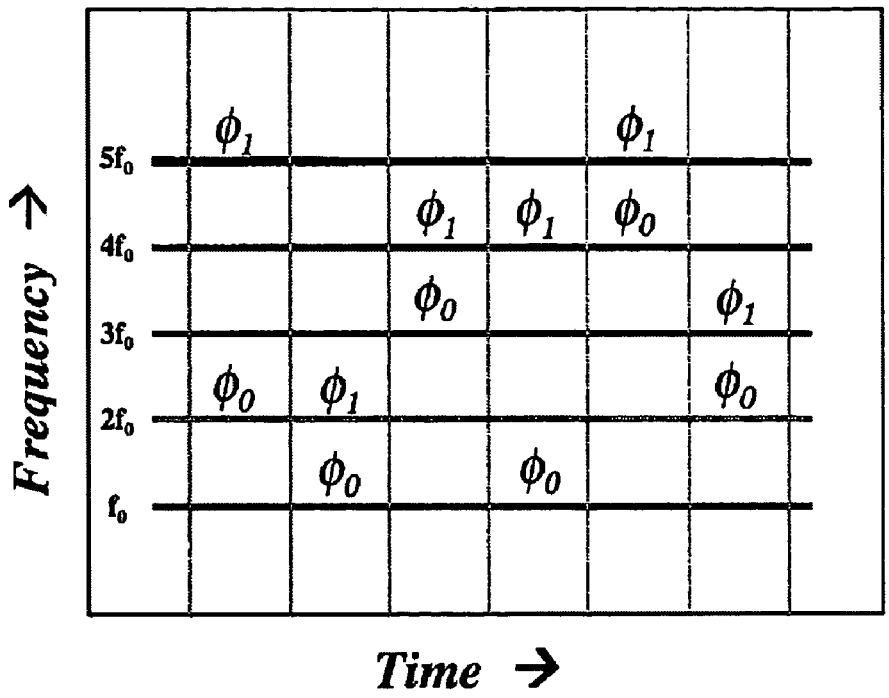
FIG. 3 is a phase diagram illustrating a first preferred embodiment of the present invention.

A first method of phase encoding is indicated in FIG. 3. In the illustrated method, during each time frame one selects a pair (or more) of frequency components of the spectrum and re-assigns their relative phases. The choice of spectral components and the selected phase shift can be chosen according to a pseudo-random sequence known only to the sender and receiver. To decode, one must compute the phase of the spectrum and correlate it with the known pseudo-random carrier sequence.

More specifically, a phase encoding scheme is indicated in which information is inserted as the relative phase of a pair of partials $\phi_0$, $\phi_1$ in the sound spectrum. In each time frame a new pair of partials may be chosen according to a pseudo-random sequence known only to the sender and receiver. The relative phase between the two chosen spectral components is then modified according to a pseudo-random sequence onto which the hidden message is encoded.

Figure 4:
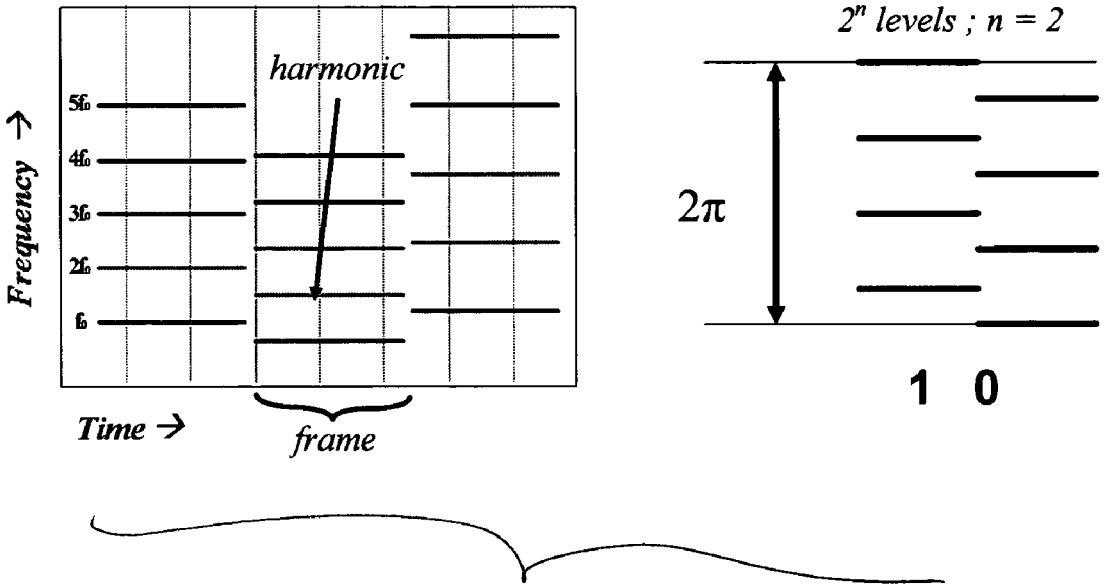
FIG. 4 is a phase diagram illustrating a second preferred embodiment of the present invention.

A second preferred embodiment, called the Relative Phase Quantization Encoding Scheme or the Quantization Index Modulation (QIM) scheme, will now be disclosed with reference to FIG. 4. In that phase encoding method the following steps are employed. One first computes the spectrum of a frame of audio data, then selects an apparent fundamental tone and its series of overtones as shown in the left plot of FIG. 4; it is convenient to select the strongest frequency component in the spectrum. Then, two of the overtones in the selected series are "relative phase quantized" according to one of two quantization scales, as shown on the right. The choice of quantization levels indicates a "1" or "0" datum. The relative phase-quantized spectrum is then inversely transformed to convert back to the time domain. The second preferred embodiment uses a variable set of phase quantization steps as explained below.

Step 1:

Segment the time representation of the audio signal S[i], $(0 \leqq i \leqq I-1)$ into series of frames of L points $S_n[i]$ where $(0 \leqq i \leqq L-1)$. At this stage, a threshold check may be applied and the frame skipped if insufficient audio power was present in the frame.

Step 2:

Compute the spectrum of each frame of audio data and calculate the phase of each frequency component within the frame, $\Phi_n(\omega_i)$ $(0 \leqq i \leqq L-1)$. An idealization of a typical spectrum with a fundamental and accompanying overtone series is shown.

Step 3:

Quantize the relative phases of two of the overtones in the selected frame according to one of two quantization scales, as shown on the right of FIG. 4.

$$\Delta\Phi = \pi/2^n$$

If '1' is to be embedded, $$\Phi_n(\omega_i) = \Delta\Phi \times \mathrm{round}(\Phi_n(\omega_i)/\Delta\Phi)$$

If '0' is to be embedded, $$\Phi_n(\omega_i) = \Delta\Phi \times \mathrm{round}(\Phi_n(\omega_i)/\Delta\Phi - 0.5) + \Delta\Phi/2$$

The number of quantization levels 'n' is variable. The greater the number of levels, the less audible the effect of phase quantization. However, when a greater number of quantization levels is employed, the probability of data recovery error increases.

Step 4:

Inverse transform the phase-quantized spectrum to convert back to the time representation of the signal by applying an L-point IFFT (inverse fast Fourier transform).

Recovery of the embedded data requires the receiver to compute the spectrum of the signal and to know which two spectral components were phase quantized. In the tests described later, the relative phase between the fundamental and the second harmonic was employed as the communication channel.

Figure 5:
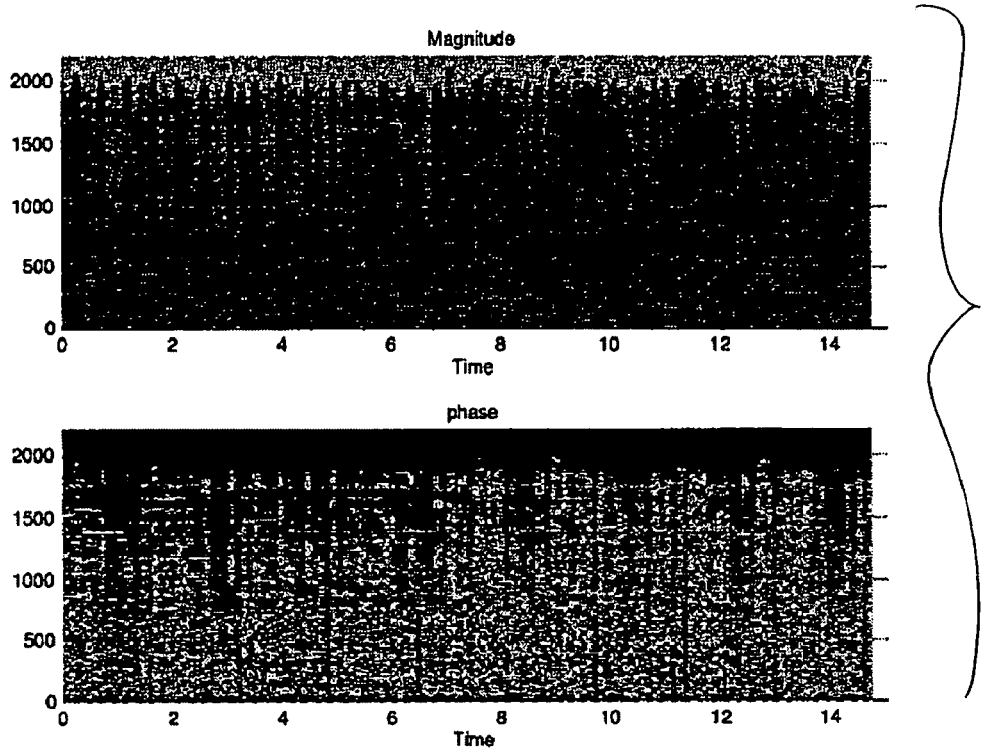
FIG. 5 is a spectrogram of a musical excerpt used to test the present invention.
Figure 6:
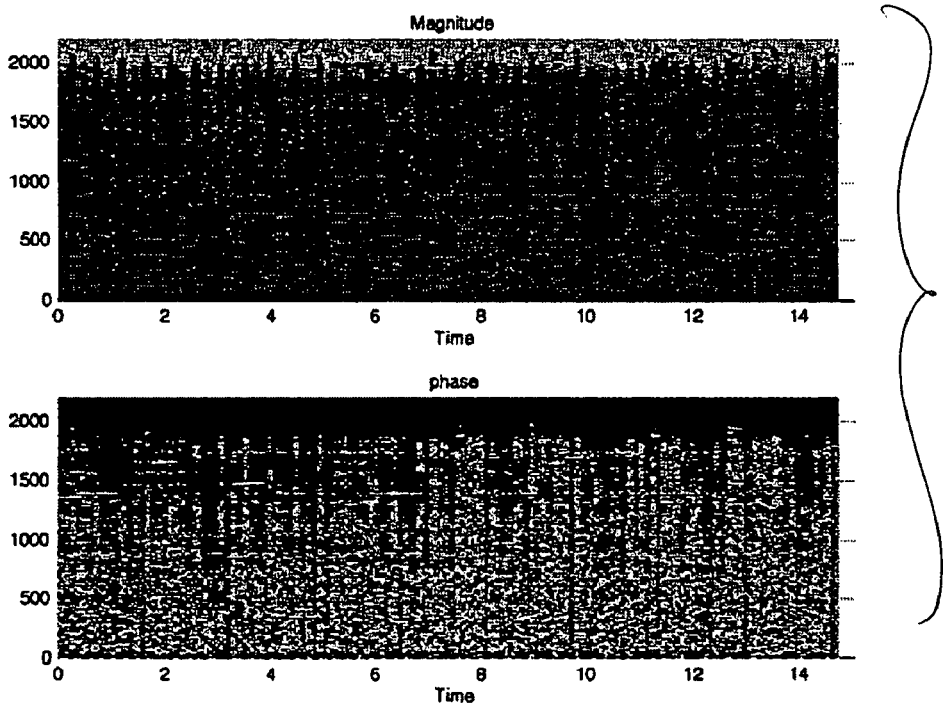
FIG. 6 is a spectrogram of the same musical excerpt with data embedded therein.

FIG. 5 shows the spectrum (magnitude is in the upper plot and the phase in the lower plot) of a musical excerpt ("Nite-Flite" by the Sammy Nestico Big Band). FIG. 6 shows the spectrum, (magnitude and phase) of the same music file with 1 kbit of hidden data. The data is encoded in the phase quantization of the second harmonic of the strongest spectral component of each frame; four quantization levels are used. There is no apparent spectral evidence of the embedded data. In this method any one or several of the spectral components may be so manipulated.

Figure 7:
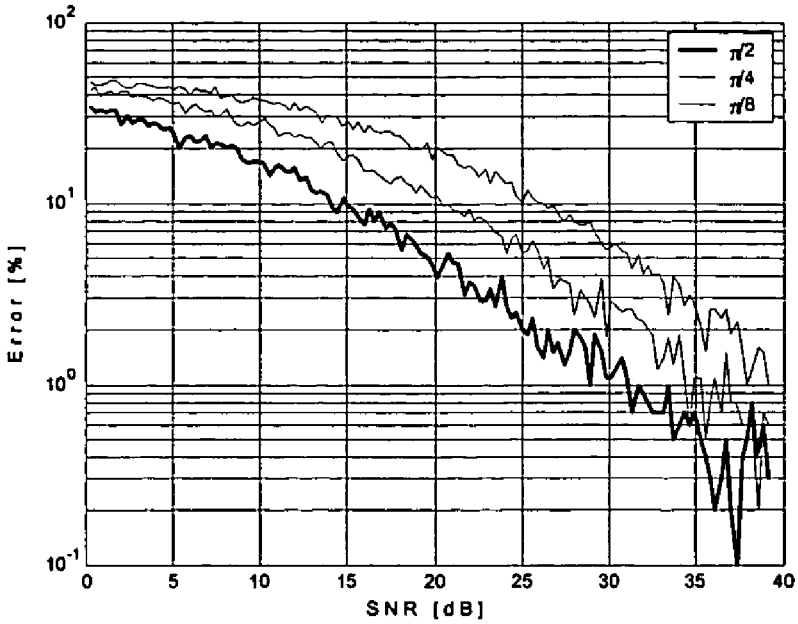
FIG. 7 is a graph of the decoding error rate as a function of signal-to-noise ratio (SNR) for three levels of quantization.

The method described above was also applied to a 23-second-long classical guitar solo. Gaussian noise was introduced prior to decoding. The relative phase between the 2 strongest harmonics of the music file was quantized and embedded with 1 kbit of binary data then followed with the decoding process in the presence of Gaussian noise. The above was done for 3 different quantization scales ($2^n$ equally spaced quantization levels), with n=1, 2 and 3 respectively. The decoding error rate at 3 different quantization levels with increasing signal to noise ratio (SNR) is shown in FIG. 7.

Applying the method described here to 512 points frames of 44,100 samples/sec audio one may encode 86 bits per second per chosen spectral line. This is slightly over 5 kbits/minute. We have also employed the method on up to 4 harmonics of the overtone spectrum with satisfactory results, raising the data capacity to approximately 20 kbits/minute.

The robustness of data against lossy compression will now be described. MP3 is a common form of lossy audio compression that employs human auditory system features, specifically frequency and temporal masking, to compress audio by a factor of approximately 1:10.

Figure 8:
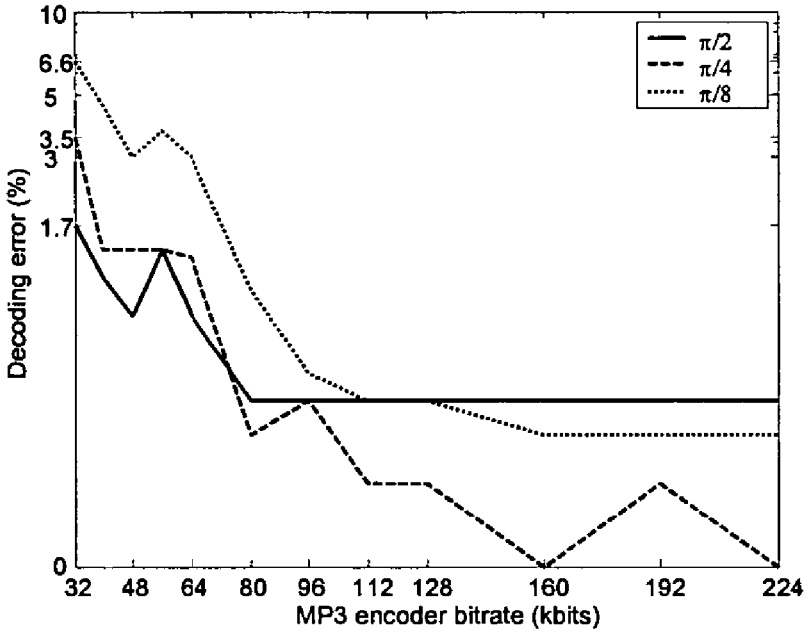
FIG. 8 is a graph of the decoding error rate as a function of MP3 encoder bit rate for three levels of quantization.

The robustness of the steganographic technique described above was evaluated by hiding data in an uncompressed (.wav) audio file followed by conversion to MP3 format and then back to .wav format. The spectrograms of the final wav files were indistinguishable from the originals, and the audio quality was typical of MP3 compressed audio. In the example presented here, we embedded 1 kbit of data in the phase of the $2^{nd}$ harmonic of the strongest spectral feature in each frame. The file was then converted to MP3 using the Lame MP3 encoder, converted back to .wav format and then examined for the presence of the hidden data. In FIG. 8, the decoding error rate is illustrated as a function of the MP3 encoder output bitrate—ranging from 32 kbit/sec to 224 kbit/sec. We explored data survivability as a function of the number of quantization steps, $2^n$, for n=1, 2, 3. The frame length employed was 576 points and the sampling frequency was 44,100 Hz.

It was found that the data recovery error rate could be reduced to near zero by employing an amplitude threshold in the selection of the segments of audio data that were encoded. A weak form of error correction could be employed to guard against such infrequent errors. One also may implement the techniques described above directly in compressed audio files, which would eliminate recovery errors.

To test the robustness of the stego message under D-A-D conversion, the audio file with the embedded binary stego message was recorded to cassette tape employing a common tape deck and then re-digitized using the same deck for play-back. The tape deck introduced amplitude modulation, nonlinear time shifts (wow and flutter) and broad-band noise.

Figure 9:
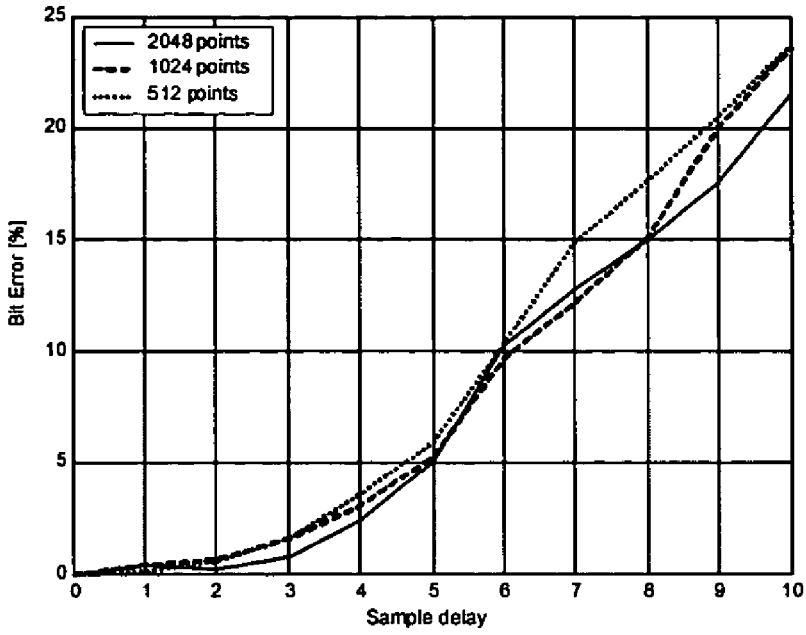
FIG. 9 is a graph of bit error rate as a function of sample density for different frame lengths.

The encoding method performs best when the decoder and the encoder are synchronized. As shown in FIG. 9, de-synchronization leads to an increased bit-recovery error rate. Therefore, a synchronization method is needed to compensate for the time shifts introduced by the D-A-D conversion process. One such method that we found to be effective is as follows. First, at the encoder we chose frames distributed periodically throughout the file to encode a stego message that is known to the decoder. At the decoder these frames serve as "synchronization frames". For example, if we encode every fourth frame in the audio file with the binary stego message '1', during decoding we may check every fourth frame to assess the instantaneous time-shift and then resynchronize the remaining data frames before decoding.

Another factor is the ratio of power between the selected harmonics. In some frames, the power ratio is too low to allow robust encoding and those frames will be skipped. We found that for a power ratio of 1:5, the robustness of the method was maintained.

Figure 10:
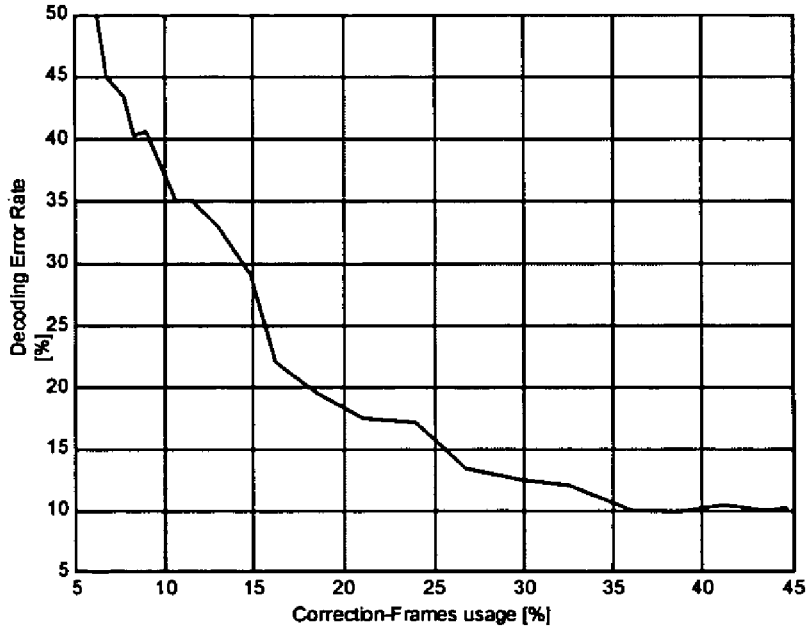
FIG. 10 is a graph of decoding error rate as a function of a rate of usage of synchronization frames.

FIG. 10 shows the decoding error rate as a function of the percentage of frames employed for synchronization. As we can see from the figure the decoding error rate decreases as the number of synchronization frames increases. For example, when 45% of the frames are employed as synchronization frames, the decoding error rate approaches 10%.

An artifact of the phase manipulation method described above is a small discontinuity at the frame boundaries caused by reassignment of the phase of one of the spectral components. Depending upon the magnitude of the discontinuity, there may be a broad spectral component, appearing as white noise, in the background of the host file spectrum. In order to reduce the magnitude of the discontinuity, three techniques have been employed. In the first, rather than reassigning the phase of a single spectral component we do so for a band of frequencies in the neighborhood of the spectral component of interest. We typically use a band of frequencies of width equal to a few percent of the signal bandwidth.

A second method is to employ an error diffusion technique using a sigma delta modulator. Background information on sigma-delta modulation is found in our U.S. Pat. No. 6,707,409, issued Mar. 16, 2004.

Figure 11:
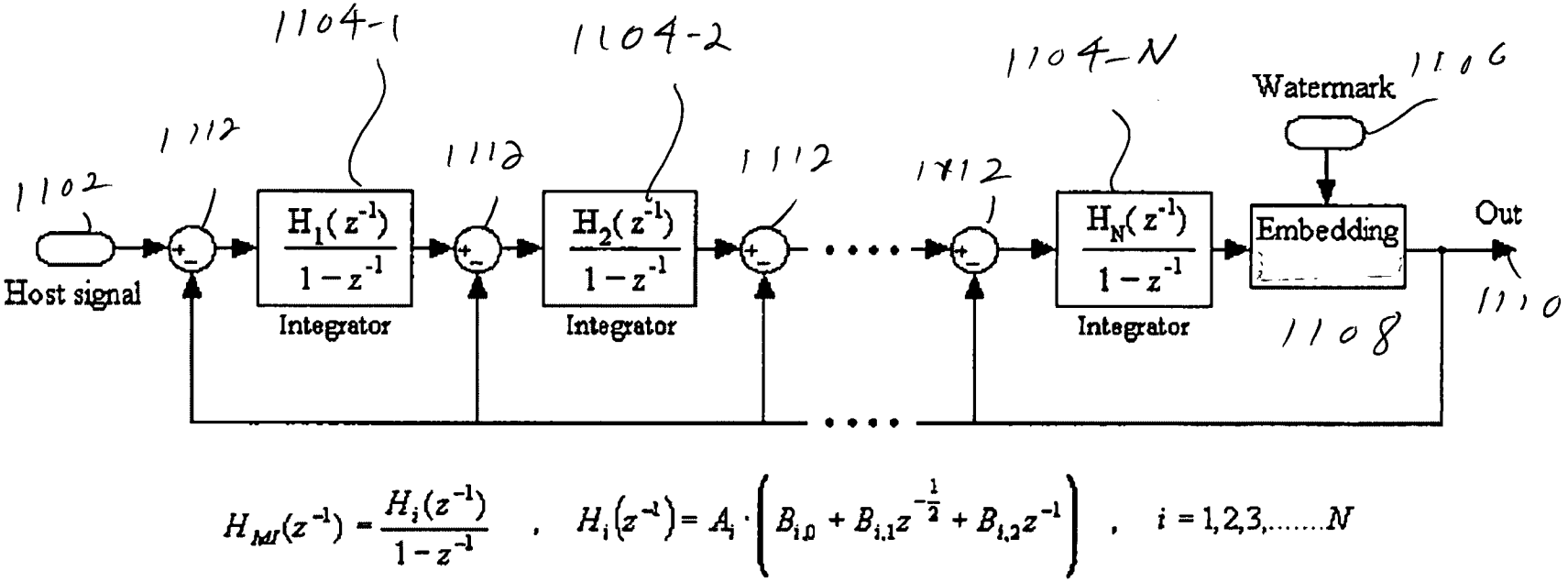
FIG. 11 is a schematic diagram showing a sigma-delta modulator for reducing phase discontinuities.

FIG. 11 shows a schematic diagram of a device for error diffusion employed in conjunction with the phase-manipulation data-hiding method. FIG. 11 represents the most general case for N-th order sigma-delta modulation as used to diffuse an error resulting from embedding data into the host signal. In the device 1100 of FIG. 11, a host signal supplied to an input 1102 is integrated through a series of integrators 1104-1, 1104-2, . . . 1104-N. The integrated signal is received in an embedding module, where a watermark or other signal received at a watermark input 1106 is embedded. The resulting signal is output through an output 1110 and is also fed back to the integrators 1104-1, 1104-2, . . . 1104-N through subtracting circuits 1112. Although the device of FIG. 11 has been applied to frame sizes of 1,024 samples, the frame size is variable, and the resulting audio quality is clearly affected by the choice of the frame size.

Although both of these methods proved to be acceptable, a third method proved to be the simplest and most effective. The third method for reducing the phase discontinuities at the frame boundaries is simply to force the phase shifts to go to zero at the frame boundaries. In our implementation we employed a raised cosine function $(1+\cos)^n$ with n=10. At the frame boundaries the phase of the chosen harmonic is not shifted and in the central region of the frame the phase is shifted by an amount equal to the difference of the original phase of the chosen harmonic and the nearest phase quantization step. The audible artifacts are eliminated in this method.

Figure 12:
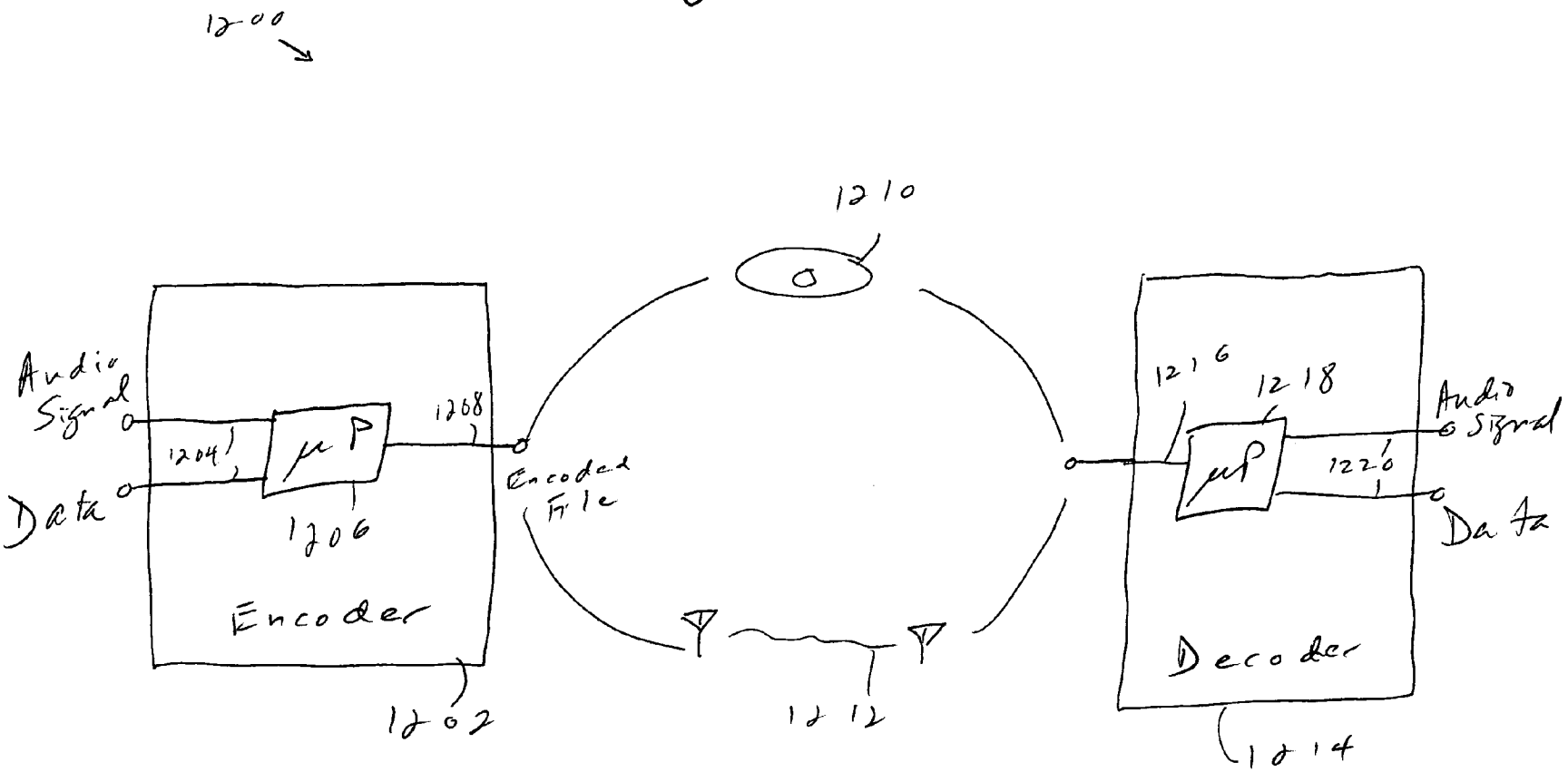
FIG. 12 is a schematic diagram showing a system on which either of the preferred embodiments can be implemented.

FIG. 12 shows a system on which the present invention, including either of the two preferred embodiments disclosed above, can be implemented. The system 1200 is shown as including an encoder 1202 and a decoder 1214, although, of course, either of the devices 1202, 1214 could have both encoding and decoding capabilities.

In the encoder 1202, the audio signal and the data to be embedded are received in an input 1204. A processor 1206 embeds the data in the audio signal and outputs the encoded file through an output 1208. From the output 1208, the encoded file can be transmitted in any suitable fashion, e.g., by being placed on a persistent storage medium 1210 (DVD, CD, tape, or the like) or by being transmitted over a live transmission system 1212.

In the decoder 1214, the encoded file is received at an input 1216. A processor 1218 extracts the embedded data from the signal and outputs the data through an output 1220. If required, the audio signal can also be output through the output 1220. For example, if the embedded data are used for watermarking purposes, the data and the audio signal can be supplied to a player which will not play the audio signal unless the required watermarking data are present.

Figure 13:
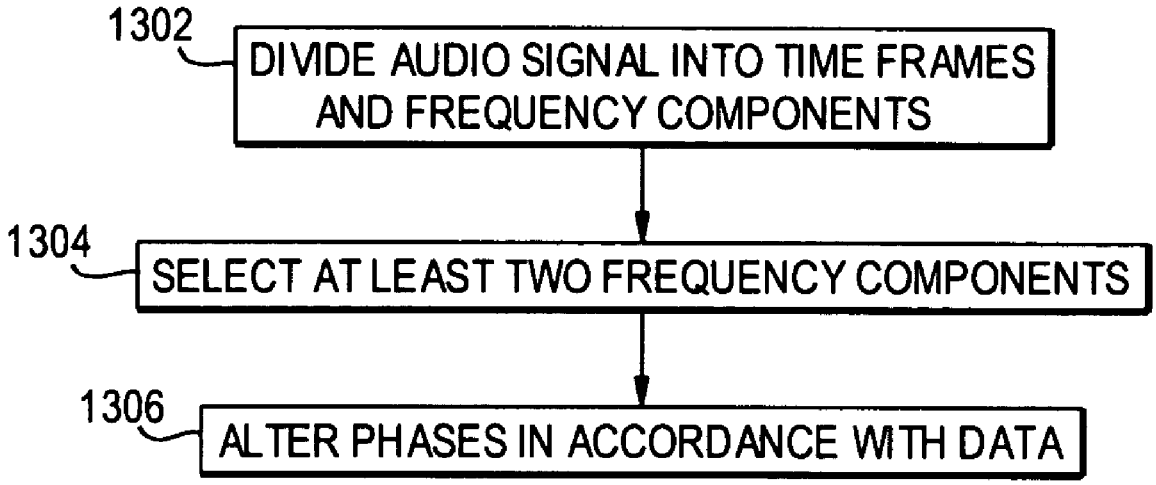
FIG. 13 is a flow chart summarizing the preferred embodiments.

The preferred embodiments will now be summarized with reference to the flow chart of FIG. 13. In step 1302, the audio signal is divided into time frames and frequency components. In step 1304, at least two frequency components are selected. In step 1306, the phases are altered in accordance with the data.

While two preferred embodiments and variations thereon have been set forth above in detail, those skilled in the art who have reviewed the present disclosure will readily appreciate that other embodiments can be realized within the scope of the invention. For example, numerical values are illustrative rather than limiting, as are recitations of specific file formats. Moreover, in addition to steganography and watermarking, any suitable use for hidden data falls within the present invention. Furthermore, the present invention can be implemented on any suitable hardware through any suitable software, firmware, or the like. Also, audio signals or files are not limited to portions of data recognized as discrete files by an operating system, but instead may be continuously recorded signals or portions thereof. Therefore, the present invention should be construed as limited only by the appended claims.

We claim:

1. A method for embedding data in an audio signal, the method comprising:

(a) dividing the audio signal into a plurality of time frames and, in each time frame, a plurality of frequency components;

(b) in each of at least some of the plurality of time frames, selecting at least two of the plurality of frequency components; and (c) altering a phase of at least one of the plurality of frequency components in accordance with the data to be embedded, wherein:

step (b) comprises selecting a fundamental tone and at least one overtone; and step (c) comprises quantizing a phase difference of the at least one overtone relative to the fundamental tone to embed at least one bit of the data to be embedded.

2. The method of claim 1, wherein:

step (b) comprises selecting a plurality of said overtones; and step (c) comprises quantizing the phase differences of the plurality of overtones selected in step (b) to embed a plurality of bits of the data to be embedded.

3. The method of claim 2, wherein step (c) further comprises inverse transforming the plurality of frequency components with the quantized phase differences.

4. A method for extracting embedded data from an audio signal, the method comprising:

(a) dividing the audio signal into a plurality of time frames and, in each time frame, a plurality of frequency components;

(b) in each of at least some of the plurality of time frames, selecting at least two of the plurality of frequency components;

(c) determining a phase shift which has been applied to at least one of the plurality of frequency components in accordance with the embedded data; and (d) from the phase shift determined in step (c), extracting the embedded data, wherein step (b) comprises selecting a fundamental tone and at least one overtone.

5. The method of claim 4, wherein step (b) comprises selecting the fundamental tone and a plurality of overtones, and wherein step (c) comprises determining the phase shift in each of the plurality of overtones.

6. A device for embedding data in an audio signal, the device comprising:

an input for receiving the audio signal and the data to be embedded;

a processor, in communication with the input, for:

(a) dividing the audio signal into a plurality of time frames and, in each time frame, a plurality of freciuency components;

(b) in each of at least some of the plurality of time frames, selecting at least two of the plurality of frequency components; and (c) altering a phase of at least one of the plurality of frequency components in accordance with the data to be embedded; and an output, in communication with the processor, for outputting a result of step (c) as the audio signal with the embedded data, wherein;

the processor performs step (b) by selecting a fundamental tone and at least one overtone; and the processor performs step (c) by quantizing a phase difference of the at least one overtone relative to the fundamental tone to embed at least one bit of the data to be embedded.

7. The device of claim 6, wherein:

the processor performs step (b) by selecting a plurality of said overtones; and the processor performs step (c) by quantizing the phase differences of the plurality of overtones selected in step (b) to embed a plurality of bits of the data to be embedded.

8. The device of claim 7, wherein the processor performs step (c) further by inverse transforming the plurality of frequency components with the quantized phase differences.

9. A device for extracting embedded data from an audio signal, the device comprising:

an input for receiving the audio signal;

a processor, in communication with the input, for:

(a) dividing the audio signal into a plurality of time frames and, in each time frame, a plurality of frequency components;

(b) in each of at least some of the plurality of time frames, selecting at least two of the plurality of frequency components;

(c) determining a phase shift which has been applied to at least one of the plurality of frequency components in accordance with the embedded data; and (d) from the phase shift determined in step (c), extracting the embedded data; and an output for outputting the embedded data, wherein the processor performs step (b) by selecting a fundamental tone and at least one overtone.

10. The device of claim 9, wherein the processor performs step (b) by selecting the fundamental tone and a plurality of overtones, and wherein step (c) comprises determining the phase shift in each of the plurality of overtones.

* * * * *